United States Patent [19]

Henricson et al.

[11] Patent Number: 4,944,840

[45] Date of Patent: Jul. 31, 1990

[54] METHOD AND APPARATUS FOR EVAPORATING WASTE LIQUOR PRODUCED WHEN COOKING FIBROUS MATERIAL CONTAINING CELLULOSE

[75] Inventors: Kaj Henricson, Kotka, Finland; Ryham, Rolf, Princeton, N.J.; Sannholm, Krister, Espoo, Finland

[73] Assignee: Ahlströmföretagen Svenska AB, Norrköping, Sweden

[21] Appl. No.: 295,825

[22] Filed: Jan. 11, 1989

[30] Foreign Application Priority Data

Jan. 14, 1988 [SE] Sweden ..... 8800100

[51] Int. Cl.[5] ..... D21C 11/06

[52] U.S. Cl. ..... 162/46; 162/42; 162/47; 162/240; 162/250

[58] Field of Search ..... 162/30.11, 30.1, 42, 162/43, 46, 47, 19, 239, 240, 250; 159/47.3, 17.2

[56] References Cited

U.S. PATENT DOCUMENTS

| | | | |
|---|---|---|---|
| 1,793,264 | 2/1931 | Tschuwikowsky et al. | 162/43 |
| 2,747,552 | 5/1956 | Kyrklund | 159/47.3 |
| 3,286,763 | 11/1966 | Jacoby | 159/47.3 |
| 3,299,942 | 1/1967 | Jucosy | 159/47.3 |
| 3,366,158 | 1/1968 | Rosenblad | 159/13.3 |
| 3,445,328 | 5/2969 | Laakso | 162/47 |

FOREIGN PATENT DOCUMENTS

| | | | |
|---|---|---|---|
| 1097465 | 3/1981 | Canada | 162/47 |
| 52127 | 2/1977 | Finland . | |
| 53142 | 10/1977 | Finland . | |
| 69968 | 9/1928 | Sweden . | |
| 301413 | 6/1968 | Sweden . | |
| 453673 | 2/1988 | Sweden . | |

*Primary Examiner*—Karen M. Hastings

*Attorney, Agent, or Firm*—Cohen, Pontani & Lieberman

[57] ABSTRACT

The present invention relates to a method and apparatus for evaporating waste liquor produced when cooking fibrous material containing cellulose in a continuous pulp digester. In the continuous cooking process, fibrous material is heated to the process temperature by direct or indirect vapor heating in the digester at an increased pressure. The invention especially relates to digesters, in which fibrous material is heated directly with vapor.

13 Claims, 2 Drawing Sheets

METHOD AND APPARATUS FOR EVAPORATING WASTE LIQUOR PRODUCED WHEN COOKING FIBROUS MATERIAL CONTAINING CELLULOSE

BACKGROUND OF THE INVENTION

In a continuous cooking process fibrous material, such as wood chips, saw dust or the like material, is fed into the upper part of an upright digester vessel, in which delignification is carried out at an increased temperature and pressure (8–10 bar).

Pulp is cooked normally at a temperature of about 170° C. The fibrous material and the cooking liquor are normally introduced into the digester at a temperature of less than 100° C. Steam is usually used for heating the fibrous material to the cooking temperature of 170° C. Heating may be carried out stage by stage in such a way that the fibrous material is first heated by low pressure steam to about 120° C., and later in the second stage by high pressure steam to about 170° C.

The products of the cooking are hot discharged waste liquor, which has a temperature of about 170° C. and hot pulp. Several methods are used in the industry to recover the heat content of waste liquor. A common way of utilizing the heat content of the discharged waste liquor is to let the waste liquor evaporate rapidly by reducing the pressure and to utilize the vapor generated thereby for heating wood chips or for evaporation as is shown in FIG. 3 of U.S. Pat. No. 3,286,763. Utilization of the energy content of waste liquor by this method is not optimal. The reduction of the temperature required by the rapid flash evaporation becomes on the one hand unnecessarily sharp and on the other hand the temperature of the vapor generated thereby is unnecessarily low. Swedish patent application 8503282-9 discloses the treatment of cooking liquor from a digester during the cooking step. The cooking liquor is withdrawn, evaporated with steam and the evaporated vapor and the cooking liquor are returned to the digester.

SUMMARY OF THE INVENTION

One of the purposes of the invention is to provide a method and an apparatus for evaporating waste liquor and for heating the fibrous material in a digester with vapor. The method in accordance with the present invention is characterized in that at least a portion of the vapor heating the fibrous material in the digester consists of the vapor which is generated when evaporating waste liquor discharged from the digester.

By using the steam from the evaporation of the waste liquor being discharged from the digester and by heating fibrous material in the digester with vapor generated by the evaporation, a better heat economy is gained than by adding fresh steam in the digester.

The apparatus in accordance with the present invention is also characterized in that the vapor space of the evaporation chamber of at least one evaporation stage, which has the same pressure as the digester, communicates with an inlet opening for the heating vapor of the digester, that the liquid space of the evaporation chamber of the first evaporation stage communicates with an outlet opening for the waste liquor of the cooker and that the heat exchange element of said evaporation stage communicates with the inlet conduit for vapor, which is hotter than the cooking temperature.

The evaporation is advantageously carried out in different stages, for example, by a "falling film"-type evaporator shown in U.S. Pat. No. 3,366,158, which has a plurality of parallel plate heat exchange elements in an evaporation chamber and in which the liquid being evaporated, in other words the waste liquor discharged from the digester, is caused to flow along the outer surfaces of the heat exchanger elements, each heat exchange element comprising a couple of mainly parallel plates which are seamed tightly to each other substantially along the whole rim of the element.

The same pressure prevails in the evaporation stages as in the digester, which must be taken into consideration in the construction of the apparatus.

BRIEF DESCRIPTION OF THE DRAWINGS

The apparatus in accordance with the present invention is described below by way of example with reference to the accompanying drawings, in which FIGS. 1 and 2 schematically illustrate two embodiments of the present invention.

DETAILED DESCRIPTION OF THE PRESENTLY PREFERRED EMBODIMENTS

Figure 1:
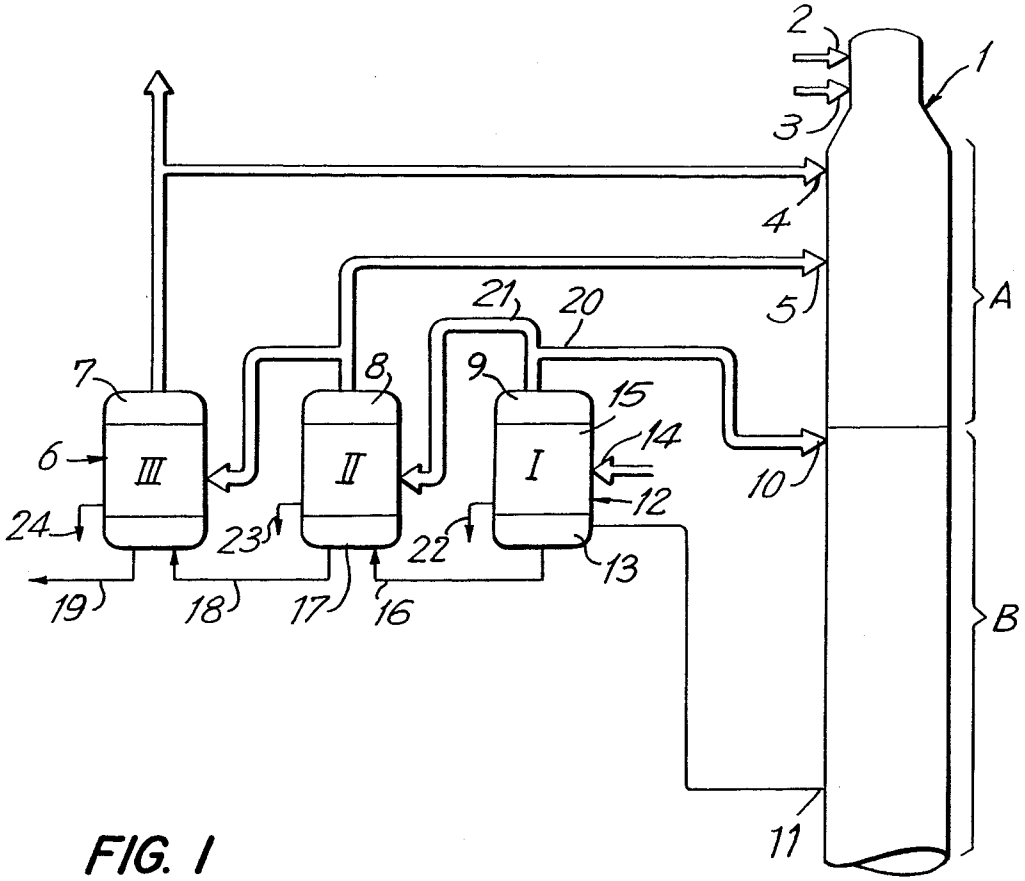

FIG. 1 illustrates the upper part of a continuous pulp digester 1, which is arranged in such a way that the fibrous material moves downwardly and that the fibrous material, which is already cooked is discharged from the lower part of the digester. Fibrous material 2, which is heated by vapor, is continuously fed pressurized via the inlet opening (not shown) in the upper part of the digester by a high pressure valve feeder. Cooking liquor 3 is fed into digester 1 either separately or together with the chips. The upper part of the digester forms an impregnation zone A, in which fibrous material is impregnated by cooking liquor at an increased pressure and temperature. In order to heat the chips to a sufficient impregnation temperature, vapor is fed preferably at two different levels to the impregnation zone A via inlet openings 4 and 5, respectively. Inlet opening 4 communicates with a vapor space 7 of an evaporation chamber 6 of the third stage (III) of the evaporation apparatus and inlet opening 5 communicates with the corresponding vapor space 8 of the second stage (II), from which space 8 vapor is discharged at a higher temperature than from the third stage. Having flown through the impregnation zone, the fibrous material is heated to the cooking temperature in the cooking zone B by vapor, which is fed through the vapor inlet opening 10 of the digester, which opening 10 communicates with vapor space 9 of the first stage (I) of the evaporation apparatus.

At the bottom of the cooking zone waste liquor is discharged through a discharge opening 11, which communicates with a liquid space 13 of an evaporation chamber 12 of the first stage (I) of the evaporation apparatus.

Fresh steam 14 which is hotter than the waste liquor discharged from the digester is supplied to the heat exchange element 15 of the first stage (I) of the evaporation apparatus.

The waste liquor which is discharged from the digester is evaporated in the first stage. The evaporated waste liquor flows thereafter through a conduit 16 to a liquid space 17 of the second stage and from the second stage through a conduit 18 to the third stage. From the third stage the concentrated waste liquor is guided through a conduit 19 to be further treated.

Part of the vapor, which is generated when evaporating waste liquor in the first stage, is guided through a conduit 20 to the digester and the rest through a conduit 21 to the second stage to be used therein as the heat medium of the third stage.

The temperature of the vapor evaporated in the first stage is the highest, for example 170° C., and the discharge vapor of the second stage is hotter, for example 150° C., than the vapor of the third stage, which may be, for example 120° C. The temperature of the vapor and the amounts of the vapor to be fed at different levels of the digester are adjusted according to the conditions set for pulp cooking so that it results in pulp with the desired delignification rate.

The condensate 22, which is generated when fresh steam 14 is condensed in the heat exchange element in the first stage, is recirculated to the feed water system of the boiler. The condensates 23 and 24 from the third stage are removed for further treatment.

Figure 2:
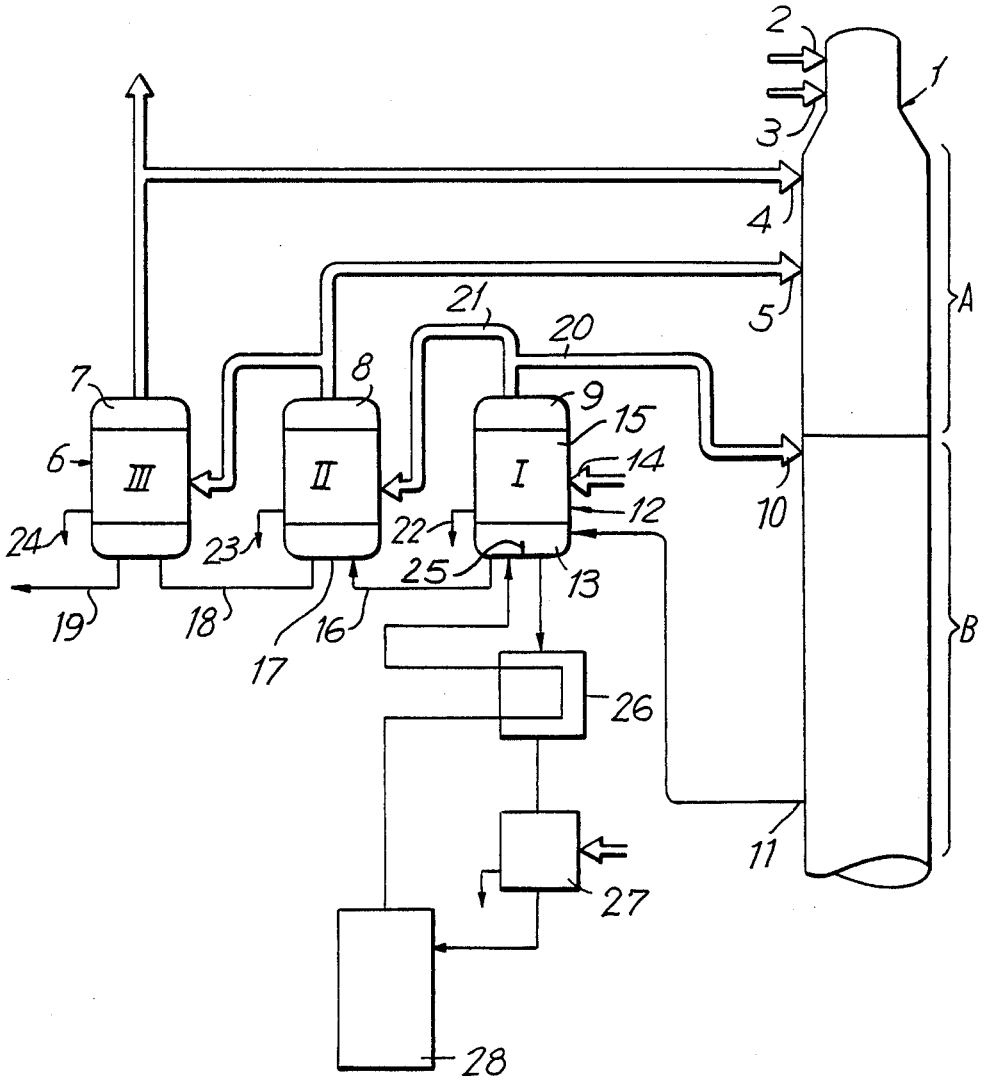

FIG. 2 discloses an alternative embodiment, which differs from the embodiment in accordance with FIG. 1 in such a way that waste liquor is heat treated according to the method for decreasing the viscosity of waste liquor described in FI patent application 854732, whereby it is possible to evaporate the waste liquor to a higher dry solids content.

The heat treatment is carried out advantageously by removing waste liquor from liquid space 13 of the first stage (I). The liquid space is divided into two parts by an intermediate wall 25, of which part one is in direct connection with the digester and the other with the second stage (II).

Waste liquor is guided from liquid space 13 through a regenerative heat exchanger 26 and a heat exchanger 27, which is heated by steam (see arrow), to a reaction chamber 28, whereby its temperature rises from 170° C. to 200° C. After the waste liquor has been in chamber 28 for about 5 to 10 minutes, said liquor is cooled in the regenerative heat exchanger to about 180° C. and is guided to the second part of the liquid space, which communicates with liquid space 17 of the second stage for transferring the concentrated waste liquor further.

The present invention is not restricted to the shown embodiments, which only illustrate examples of the possibilities to realize the invention, but it can deviate within the range of the inventional concept of the enclosed patent claims. Thus part of the concentrated waste liquor may be, for example, returned to the digester to adjust the concentration of the liquor in the digester. The method in accordance with the present invention does not exclude the possibility that part of the fresh steam flows directly to the digester to adjust the cooking temperature.

Hence it should be understood that the preferred embodiments described above are for illustrative purposes only and are not to be construed as limiting the scope of the invention which is properly delineated only in the appended claims.

What is claimed is:

1. A method of evaporating waste liquor comprising:

(a) introducing fibrous cellulose containing material and cooking liquor into a continuous pulp digester having a cooking zone below an impregnation zone;

(b) heating said fibrous material to the cooking temperature by the addition of vapor to said cooking zone;

(c) discharging waste liquor from said digester;

(d) introducing said discharged waste liquor into a first of multiple evaporation stages;

(e) evaporating said waste liquor in said first evaporation stage by the addition of a heat medium;

(f) generating vapor in said evaporation stages;

(g) evaporating said waste liquor in a second evaporation stage by the addition of vapor generated in said first stage;

(h) evaporating said waste liquor in a third evaporation stage by the addition of vapor generated in said second stage;

(i) directly introducing into said cooking zone at least part of said vapor generated in said first evaporation stage for heating said fibrous material in step (b); and (j) introducing into said impregnation zone at least part of said vapor generated in said second and third evaporation stages at different levels and at a temperature below said cooking temperature.

2. The method in accordance with claim 1, wherein the heat medium used for the first evaporation is fresh steam, having a higher temperature than the temperature of the discharged waste liquor.

3. The method according to claim 2, wherein said evaporation is carried out in three stages and wherein said vapor from said first evaporation stage is returned into said cooking zone at a temperature of about 170°; said vapor exiting from said second evaporation stage is returned to a vapor inlet in said impregnation zone at a temperature of about 150° C.; and wherein said vapor from said third evaporation stage is returned into said impregnation zone at a temperature of about 120° and at a level above the vapor inlet from said second stage.

4. The method in accordance with claim 1, wherein the evaporated waste liquor is guided back to the digester.

5. The method in accordance with claim 1, additionally comprising the step of heating the discharged waste liquor in connection with said first evaporation stage to a temperature which is higher than the cooking temperature for decreasing the viscosity thereof.

6. The method in accordance with claim 1, additionally comprising the steps of withdrawing waste liquor from said first evaporation stage and heating said liquor to a temperature which is higher than the cooking temperature for decreasing the viscosity thereof.

7. The method of claim 1, wherein the cooking temperature is about 170° C.

8. The method of claim 5, wherein the heating temperature is in the range from about 170° C. to about 200° C.

9. An apparatus for evaporating waste liquor containing fibrous cellulose material comprising:

a continuous digester for cooking said fibrous material at the cooking temperature, said digester comprising an impregnation zone and a cooking zone below said impregnation zone, an inlet opening for heating vapor in said cooking zone and a discharge opening for waste liquor;

a plurality of evaporation stages, the first evaporator stage comprising a vapor space, an evaporation chamber, a heat exchange element within said chamber, and a liquid space; means for maintaining the same pressure in said evaporation chamber as in said digester; said vapor space being in direct fluid communication with said heating vapor inlet opening in said cooking zone of said digester; said liquid space being in fluid communication with said waste liquor discharge opening of said digester; said heat exchange element of said first evaporation stage having an inlet for introducing vapor at a temperature higher than said cooking temperature; the second evaporation stage comprising a second evaporation chamber and a second vapor space, a vapor outlet, a second heat exchange element and a second liquid space within said second evaporation chamber; said second vapor space being connected to said first vapor space of said first evaporation stage and said second vapor outlet being connected to said impregnation zone; and the third evaporation stage comprising a third evaporation chamber including a third vapor space, a third vapor outlet, a third heat exchange element and a third liquid space within said third evaporation chamber, said second vapor space being connected to said third heat exchange element, and said third vapor space being connected to said impregnation zone at a level above said connection of said second vapor outlet.

10. An apparatus for evaporating waste liquor containing fibrous cellulose material comprising:

means for continuously digesting said fibrous material at a cooking temperature comprising an impregnation zone and a cooking zone below and in fluid communication with said impregnation zone;

an inlet for said fibrous material and an inlet for cooking liquor within said impregnation zone;

a vapor inlet and an outlet in said cooking zone for the discharge of waste liquor;

a first evaporation stage comprising an evaporation chamber having a waste liquor inlet connected to said waste liquor outlet of said digester;

a heat exchanger within said chamber having a vapor inlet;

a liquid space below said heat exchanger;

a vapor space above said heat exchanger; and a conduit connecting said vapor space with said cooking zone;

a second evaporation stage comprising an evaporation chamber having a waste liquor inlet connected to said liquid space of said first evaporation stage;

a heat exchanger within said chamber having a vapor inlet;

a liquid space below said heat at exchanger;

a vapor space above said heat at exchanger;

a conduit connecting said vapor space with said impregnation zone; and a conduit connecting said vapor space of said first evaporation stage with said vapor inlet of said heat exchanger of said second evaporation stage;

a third evaporation stage comprising an evaporation chamber having a waste liquor inlet connected to said liquid space of said second evaporation stage;

a heat exchanger within said chamber having a vapor inlet;

a liquid space below said heat exchanger;

a vapor space above said heat exchanger;

a conduit connecting said vapor space with said impregnation zone; and a conduit connecting said vapor space of said second evaporation stage with said vapor inlet of said heat exchanger of said third evaporation stage.

11. The apparatus of claim 10 additionally comprising:

means for heating waste liquor withdrawn from said liquid space of said first evaporation stage at a temperature above the cooking temperature for decreasing the viscosity thereof; and means for returning the heated treated liquor back to said liquid space.

12. The apparatus of claim 11, further comprising:

a heat exchanger between said liquid space of said first evaporator stage and said heating means for pre-heating said liquor.

13. The apparatus of claim 12, wherein the means for heating said liquor comprises a heat exchanger and a reaction chamber.

* * * * *